US010441056B2

(12) United States Patent
Lefevre et al.

(10) Patent No.: US 10,441,056 B2
(45) Date of Patent: Oct. 15, 2019

(54) WRINGING DEVICE FOR A LIQUID OR PASTY MATERIAL APPLICATOR

(71) Applicant: PARFUMS CHRISTIAN DIOR, Paris (FR)

(72) Inventors: Savine Lefevre, Compiegne (FR); Francois Gautier, Colombes (FR)

(73) Assignee: PARFUMS CHRISTIAN DIOR, Paris (FR)

( * ) Notice: Subject to any disclaimer, the term of this patent is extended or adjusted under 35 U.S.C. 154(b) by 72 days.

(21) Appl. No.: 15/563,258

(22) PCT Filed: Mar. 31, 2016

(86) PCT No.: PCT/FR2016/050725
§ 371 (c)(1),
(2) Date: Sep. 29, 2017

(87) PCT Pub. No.: WO2016/156742
PCT Pub. Date: Oct. 6, 2016

(65) Prior Publication Data

US 2018/0092451 A1 Apr. 5, 2018

(30) Foreign Application Priority Data

Apr. 1, 2015 (FR) ..... 15 52792

(51) Int. Cl.
*A45D 40/26* (2006.01)
*A45D 34/04* (2006.01)

(52) U.S. Cl.
CPC ..... *A45D 40/267* (2013.01); *A45D 34/04* (2013.01); *A45D 34/046* (2013.01)

(58) Field of Classification Search
CPC .... A45D 40/267; A45D 34/04; A45D 34/046; A45D 34/047; A45D 40/268
See application file for complete search history.

(56) References Cited

U.S. PATENT DOCUMENTS 5,597,254 A 1/1997 Vasas
8,783,987 B2 * 7/2014 Kulik ..... A45D 34/046 401/122

(Continued)

FOREIGN PATENT DOCUMENTS

GB 2352167 A 1/2001
JP 5370656 11/2010
WO 9849918 A1 11/1998

OTHER PUBLICATIONS

International Search Report issued in International Application No. PTC/FR2016/050725 dated Jun. 30, 2016 (5 pages).

(Continued)

*Primary Examiner* — David J Walczak
(74) *Attorney, Agent, or Firm* — Hamre, Schumann, Mueller & Larson, P.C.

(57) ABSTRACT

A wiper device (10) for a liquid or paste applicator (30), the wiper device comprising a tubular body (12) having an axis (X), and a plurality of blades (20) that extend from the tubular body (12) and that are arranged around the axis (X), each blade (20) comprising a proximal end (22) that is close to the tubular body, a distal end (26), and an intermediate portion (24), the wiper device being characterized in that the intermediate portion (24) of each blade is closer to the axis (X) of the tubular body (12) than are the proximal and distal ends (22, 26) of said blade (20). A liquid or paste applicator unit including such a wiper device.

10 Claims, 3 Drawing Sheets

(56) References Cited

U.S. PATENT DOCUMENTS

| | | | | |
|---|---|---|---|---|
| 2003/0196672 | A1* | 10/2003 | Kirita | A45D 34/046<br>132/218 |
| 2013/0101335 | A1 | 4/2013 | Kulik | |
| 2013/0101337 | A1 | 4/2013 | Kulik | |

OTHER PUBLICATIONS

Written Opinion issued in International Application No. PTC/FR2016/050725 dated Jun. 30, 2016 (4 pages).

* cited by examiner

WRINGING DEVICE FOR A LIQUID OR PASTY MATERIAL APPLICATOR

FIELD OF THE INVENTION

The present description relates to a wiper device for wiping a liquid or paste applicator. The applicator may be adapted to a cosmetic, e.g. it may be a mascara brush, or it may be adapted to any liquid or paste for application to a surface by a brush, or the like.

TECHNOLOGICAL BACKGROUND

By way of example, US patent No. 2013/0101337 discloses a wiper device for a cosmetic applicator, which wiper device comprises a tubular body having an axis, and a plurality of blades that extend from the tubular body and that are arranged around the axis. Each blade comprises a proximal end that is close to the tubular body, a distal end, and an intermediate portion. In particular, each blade includes a fin that extends radially, perpendicularly to the axis and towards the axis, the fins of the various blades being situated at various distances from the tubular body.

However, such a wiper device is not entirely satisfactory. In particular, it does not make it possible to guarantee that the applicator wipes uniformly, while distributing the fluid on the applicator. A need thus exists for a novel type of wiper device.

PRESENTATION OF THE INVENTION

To this end, the present description relates to a wiper device for a liquid or paste applicator, the wiper device comprising a tubular body having an axis, and a plurality of blades that extend from the tubular body and that are arranged around the axis, each blade comprising a proximal end that is close to the tubular body, a distal end, and an intermediate portion, the wiper device being characterized in that the intermediate portion of each blade is closer to the axis of the tubular body than are the proximal and distal ends of said blade.

Thus, the blades are adapted to wipe the entire applicator, in particular when the applicator comprises a stem and an applicator member. Optionally, the blades are flexible. Unless mentioned to the contrary, all of the geometrical characteristics are given at rest for the wiper device while it is not mechanically stressed. For reasons of concision, the term "height" is used for the dimension measured along the axis of the tubular body. Unless mentioned to the contrary, the axial, radial, and tangential (circumferential) directions are defined in their usual senses, taking the axis of the tubular body as reference axis. Unless mentioned to the contrary, the terms inside, inner, outside, and outer are considered along a radial direction.

As a result of their shape, the blades make it possible to homogenize the fluid going from the axis of the applicator, which generally coincides with, or is close to, the axis of the tubular body, towards its periphery. In addition, as a result of the intermediate portion of each blade being closer to the axis of the tubular body than the distal end of said blade, it is possible to scrape off any excess fluid that is present on the applicator. The proposed wiper device thus simultaneously ensures that the fluid is distributed radially and is measured out on the applicator.

The blades are spaced apart from one another. For example, the circumferential spacing of the blades may be at least equal, substantially equal, or at most equal to the circumferential width of the blades, depending on the height under consideration.

In the proposed embodiment, the blades define an internal volume that is concave. In an example, the blades may define an internal volume that is generally diabolo (hourglass) shaped. In an example, the blades may define an internal volume that is generally in the shape of a double frustoconical cone, the frustum being cut on either side of the apex of the cone. It should be recalled that the term cone designates a surface formed by a straight line, referred to as a generator line, that sweeps along a closed outline in a plane and that passes through a fixed point, referred to as the apex of the cone, and that does not lie in the plane of the outline. The term cone may also designate the volume defined by said surface.

In certain embodiments, at least some of the blades are swirled (wound), at least in part, having successive radial sections that are progressively offset relative to one another. In the direction of the axis of the tubular body, each blade is seen as a stack of radial sections. In these embodiments, the radial sections are offset relative to one another. This results from the fact that the line defined by the centers of gravity (barycenters) of successive radial sections, also referred to as a "director line" is not parallel to the axis. Thus, the director line of each of said blades is not contained in an axial plane (a plane containing the axis of the tubular body). In other words, the blades wind around the axis, along the circumference of the wiper device. As a result of this characteristic, the wiper device makes it possible to treat the entire circumference of the applicator, even though gaps exist between the blades.

In certain embodiments, at least some of the blades have cross-sections that are not circular, and they are blades that are twisted, at least in part. A twisted portion of a blade is a portion in which the blade is twisted about its own axis. By using the term "cross-section" of a blade to designate a section of the blade that is perpendicular to a director line of the blade, the successive cross-sections turn progressively relative to one another. This makes it possible to wipe the applicator member while distributing the fluid within the applicator member. For example, the distal end may be twisted relative to the proximal end. The above-mentioned director line is defined locally and may be curved.

In certain embodiments, the distal ends of at least some of the blades are free. Thus, the distal ends of the blades are not directly connected to one another. The distal ends of the blades are thus independent of one another in their wiping movement, which enables them to adapt to any shape of applicator. Alternatively, the distal ends of some groups of blades are free. However, the blades may be connected in pairs or in other configurations, but without all of the blades being connected together.

In certain embodiments, the blades are more flexible than a stem of the liquid or paste applicator. The blades thus move apart as the stem passes between them, and they wipe the stem very closely. Conversely, the blades may be less flexible than the applicator member, such that the blades act to distribute the fluid on the applicator member.

In certain embodiments, the end faces of some of the blades are not perpendicular to the axis. The end face of a blade is the face or the face portion that is the furthest from the tubular body. In particular, the end face may be defined by the distal end of a blade. In this way, each of the blades may present a tip and a vanishing corner. When the tip is axially further away from the tubular body than the vanishing corner, the tip penetrates into the applicator member first. In other words, the distal ends of the blades present a bevel so as to make it easier for the blades to engage in the applicator member.

When, in combination with these embodiments, the blades are also twisted, the tips and the vanishing corners are inscribed on different outlines. In an orientation example, the tips may thus penetrate into the applicator member radially on the inside, while the vanishing corners may penetrate into the applicator member radially on the outside. This results in reinforcing the effect of homogenizing the fluid on the applicator. Thus, depending on the twisting direction of the blades, the orientation of the end faces makes it possible to scrape off and/or to measure out the fluid, or conversely to cause the fluid to penetrate deep into the applicator member, i.e. radially towards the inside of the applicator member. For example, while projecting on a radial plane (a plane that is orthogonal to the axis), the tips may lie inside the outline in which the vanishing corners are inscribed.

In certain embodiments, the radially-inner faces of at least some of the blades are curved, at least over a fraction of the height of said blades. This makes it possible to improve the distribution of the fluid circumferentially and, where appropriate, to match the shape of the applicator better.

In certain embodiments, a proximal portion, situated between the intermediate portion and the proximal end, approaches the axis on going away from the body, while a distal portion, situated between the intermediate portion and the distal end, departs from the axis on going away from the body.

In certain embodiments, a radial section of a blade in the intermediate portion has an area that is less than the area of a radial section in the distal portion or the proximal portion of said blade. This makes it possible to keep a spacing between the blades that is substantially constant and in proportion over the entire height of the blades. In these embodiments, the risks of blockage and of fluid clumping in the wiper device, in particular between the blades, are particularly small.

In certain embodiments, in projection onto a plane that is orthogonal to the axis of the tubular body, the angular sectors occupied by the distal portions and by the proximal portions substantially cover a complete turn. The projections of the proximal and distal portions may overlap, or they may merely be adjacent. Thus, the applicator member is wiped over its entire circumference.

In certain embodiments, the projections of intermediate segments comprising the intermediate portions onto a plane that is orthogonal to the axis, cover a complete turn. The term "intermediate segment" of a blade means a segment comprising the intermediate portion, and the portions of said blade that are situated on either side of the intermediate portion, in so far as their distance to the axis varies by at most X % of (dmax−dmin) relative to the distance to the axis of the intermediate portion, where dmax designates the maximum distance (and dmin the minimum distance) from the blade to the axis, and X advantageously lies in the range 20 to 50, preferably being about 30. In these embodiments, the projections of the intermediate segments may overlap, or they may merely be adjacent. By means of such arrangements, the narrowest portion of the applicator, e.g. its stem, is wiped over its entire circumference.

The present description also relates to a liquid or paste applicator unit comprising a container having a neck, an applicator having a stem that is provided with an applicator member, and a wiper device as described above. The wiper device is for mounting in the neck of the container.

In certain embodiments, the smallest diametral dimension defined between the facing inner faces of the blades is less than a diameter of a cross-section of the stem. A cross-section of the stem is a section that is perpendicular to the director line of the stem. This definition may be considered locally when the director line is not rectilinear. The facing inner faces of the blades are the inner faces of the blades that face each other in pairs. The diametral dimension is the dimension between two blades that are substantially diametrically opposite. When two blades are not exactly diametrically opposite, e.g. when there is an odd number of blades, it is the dimension between the two blades that are the furthest apart circumferentially; in other words, from a given blade, the substantially diametrically opposite blade(s) is/are the blade(s) circumferentially closest to the point diametrically opposite the given blade. In these embodiments, the stem is well wiped.

In certain embodiments, the greatest diametral dimension of the applicator member is less than the greatest diametral dimension defined between the facing inner faces of the blades. Thus, the entire applicator member is well wiped by the blades.

BRIEF DESCRIPTION OF THE DRAWINGS

The invention and its advantages can be better understood on reading the following detailed description of embodiments of the invention given by way of non-limiting examples. The description refers to the accompanying drawings, in which.

DETAILED DESCRIPTION OF THE INVENTION

Figure 1:
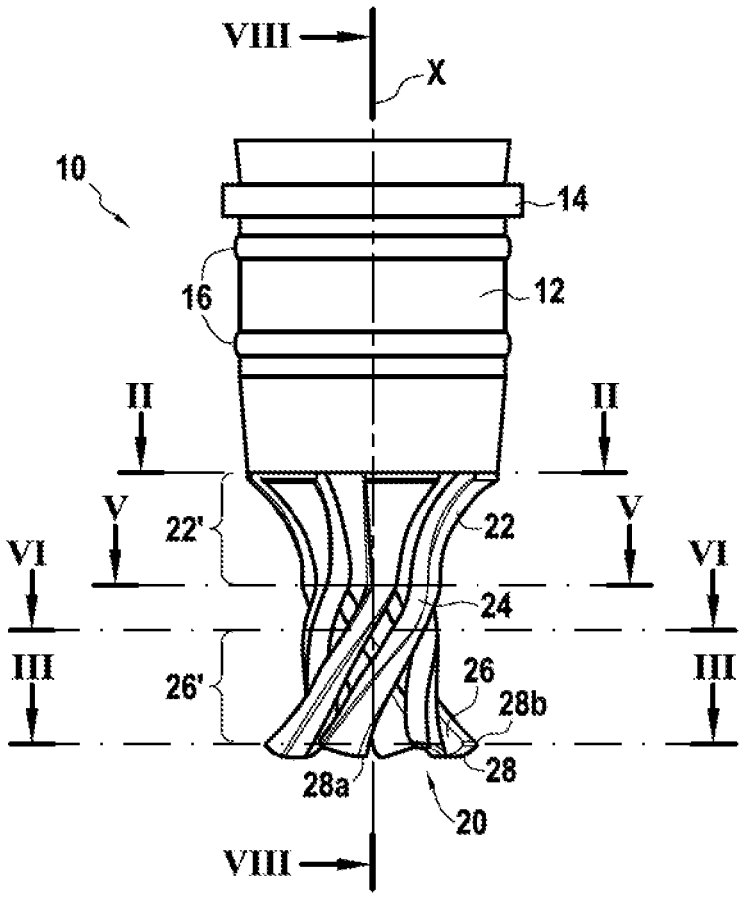
FIG. 1 is a front view showing a wiper device in an embodiment of the invention.

FIG. 1 is a front view of a wiper device 10 in an embodiment. As indicated above, the wiper device 10 includes a tubular body 12 having an axis X. In this embodiment, the tubular body 12 is axisymetric about its axis X. The tubular body 12 includes an abutment 14. In addition, the tubular body 12 includes beads 16. As can be seen in greater detail below and with reference to FIG. 8, the abutment 14 and the beads 16 contribute to engaging and fastening the wiper device 10 in a container or a bottle, and to sealing the applicator unit.

The tubular body 12 further includes a plurality of blades 20 that extend from the tubular body 12 and that are arranged around the axis X. In this embodiment, the wiper device 10 includes six blades 20. Each blade 20 comprises a proximal end 22 that is close to the tubular body 12, a distal end 26, and an intermediate portion 24. Thus, each blade possesses a proximal portion 22' that is situated between the proximal end 22 and the intermediate portion 24, and a distal portion 26' that is situated between the distal end 26 and the intermediate portion 24.

In accordance with the invention, the intermediate portion 24 of each blade 20 is closer to the axis X of the tubular body than is the distal end 26 of said blade. In addition, the intermediate portion 24 of each blade 20 is closer to the axis X of the tubular body than is the proximal end 22 of said blade.

The wiper device 10 is formed of a flexible material, e.g. thermoplastic material or elastomer, such as polypropylene (PP), polyethylene (PE), nitrile butadiene rubber (NBR), styrene butadiene rubber (SBR), or ethylene propylene diene monomer (EPDM).

As can be seen in FIG. 1, the distal ends 26 of the blades 20 are free. The blades 20 are connected to one another only by means of the tubular body 12.

In addition, at its distal end 26, each blade 20 includes an end face 28. As shown in FIG. 1, the end faces 28 of some blades 20 are not perpendicular to the axis X. Specifically, none of the end faces 28 are perpendicular to the axis X. More precisely, each blade 20 possesses a tip 28*a* and a vanishing corner 28*b*. The tip 28*a* and the vanishing corner 28*b* are situated on either side of the end face 28. The tip 28*a* is axially further away from the tubular body 12 than is the vanishing corner 28*b*, so as to make it easier to engage the blades 20 in an applicator member in order to wipe it.

FIG. 1 also shows that the blades 20 are firstly swirled, i.e. in this embodiment they slope along the circumference of the wiper device 10, and secondly they are twisted, in this embodiment twisted longitudinally about their own axes. In particular, in the present embodiment, each blade 20 is swirled so as to extend over an arc of more than 30°, better still of more than 50°, or of more than 90°, about the axis X. These features are described in detail below with reference to the following figures.

Figure 2:
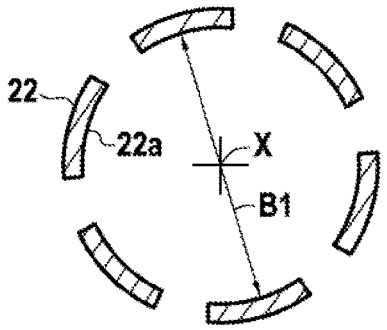
FIG. 2 is a section view on II-II of the FIG. 1 wiper device.

FIG. 2 shows the wiper device 10 in radial section on plane II-II of FIG. 1. More precisely, FIG. 2 shows the blades 20 in section at their proximal ends 22.

As indicated above, at least some of the blades 20 have radial sections that are not circular.

Furthermore, the radially-inner faces 22*a* of at least some of the blades 20, and in this embodiment all of the blades 20, are curved.

Figure 8:
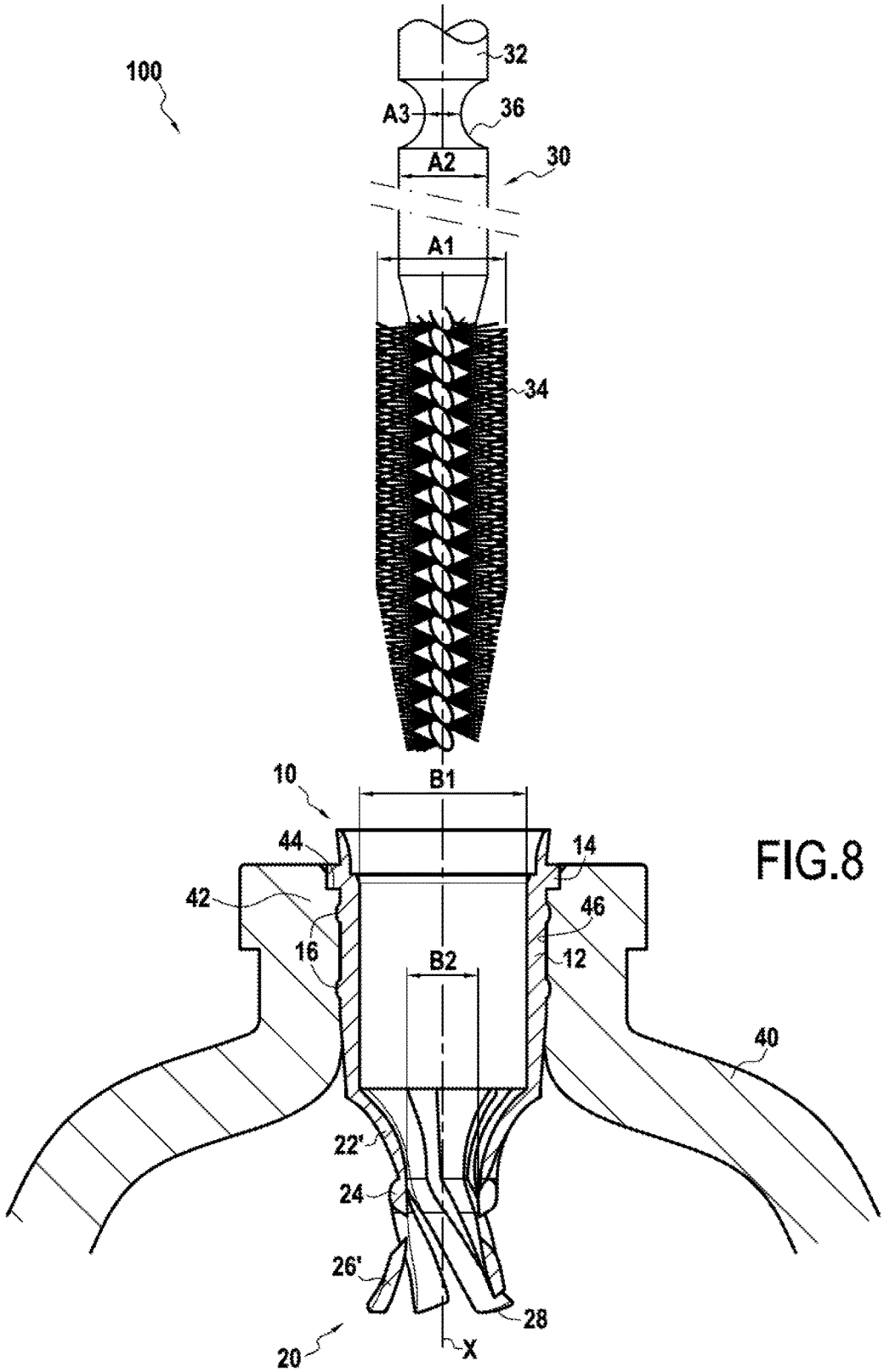
FIG. 8 shows a liquid or paste applicator unit in an embodiment of the invention, in which the wiper device is shown in section on the plane VIII-VIII of the FIG. 1.

As marked in FIG. 2, the greatest diametral dimension defined between the facing inner faces 22*a* of the blades 20 is written B1 (see also FIG. 8). In the embodiment described, the greatest diametral dimension is reached at the proximal ends 22 of the blades 20, but it could be reached at some other height along the blades 20, e.g. at the distal ends 26.

Figure 3:
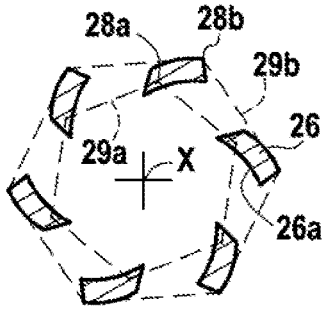
FIG. 3 is a section view on III-III of the FIG. 1 wiper device.

FIG. 3 shows the wiper device 10 in radial section on plane III-III of FIG. 1. More precisely, FIG. 3 shows the blades 20 in section at their proximal ends 26. As shown in manner similar to the proximal ends 22, and even though these aspects are independent, in their distal portions 26', the blades 20 have radial sections that are not circular; furthermore, the radially-inner faces 26*a* of at least some of the blades 20, and in this embodiment all of the blades 20, are curved.

Figure 4:
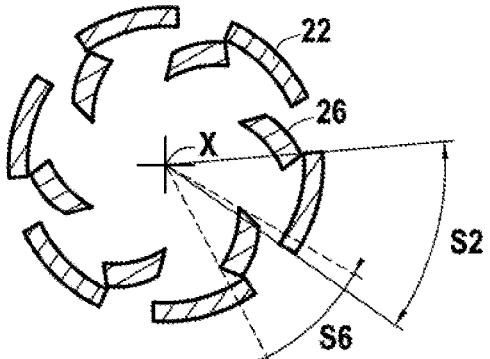
FIG. 4 is a superposition of FIGS. 2 and 3.

FIG. 4 is a superposition of the sections in FIGS. 2 and 3. The swirled nature of the blades 20 give rise to the fact that the distal portions 26' occupy angular sectors relative to the axis X that are different, at least in part, from the angular sectors occupied by the proximal portions 22'. Specifically, the radial sections of the blades 20 are offset progressively relative to one another along the blades 20.

Specifically, the proximal ends 22, or more generally the proximal portions 22', wipe a sector S2. The distal ends 26, or more generally the distal portions 26', wipe a sector S6. As a result of the overlap between the sectors S2 wiped by the proximal portions 22' and the sectors S6 wiped by the distal portions 26', there is no angular sector that is not covered by a blade portion 20. In this way, in projection onto a plane that is orthogonal to the axis X of the tubular body 12, the angular sectors S2, S6 occupied by the distal portions 26' and by the proximal portions 22' substantially cover a complete turn.

In addition, it can be seen in FIG. 4 that the blades 20 are twisted, at least in part. More particularly, in this embodiment, the distal ends 26 are twisted relative to the proximal ends 22. This gives rise to the fact that a face of a blade 20 arranged in a certain direction at a certain height is arranged in a different direction at some other height. Specifically and by way of example, the inner face 22*a* of the proximal end 22 is arranged in a circumferential direction, while the inner face 26*a* of the distal end 26 of the same blade 20 is arranged in a direction that is not circumferential.

As a result of the blades 20 being twisted, the tips 28*a* and the vanishing corners 28*b* are arranged on different outlines. For example, an outline may be construed as an imaginary line that connects each tip 28*a* (or each vanishing corner 28*b* as appropriate) to the two tips (or the two vanishing corners as appropriate) that are the closest thereto. In the present embodiment, the tips 28*a* are arranged on an outline 29*a*, and the vanishing corners 28*b* are arranged on an outline 29*b*. Each outline should have the same degree of symmetry as the wiper device. Specifically, as shown in FIG. 3, the outline 29*a* and the outline 29*b* are both hexagonal, independently from each other.

The outlines 29*a*, 29*b* are distinct. In this embodiment, the outline 29*a* in which the tips 28*a* are inscribed is inside the outline 29*b* in which the vanishing corners 28*b* are inscribed.

Figure 5:
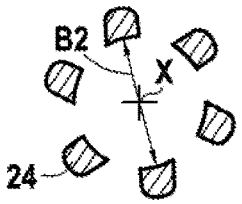
FIG. 5 is a section view on V-V of the FIG. 1 wiper device.
Figure 6:
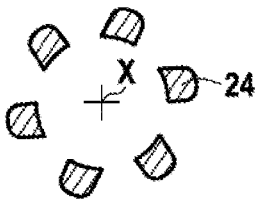
FIG. 6 is a section view on VI-VI of the FIG. 1 wiper device.
Figure 7:
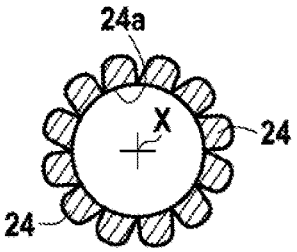
FIG. 7 is a superposition of FIGS. 5 and 6.

FIGS. 5 to 7 respectively show views that are similar to the views in FIGS. 2 to 4, relating to the intermediate portions 24. More precisely, FIG. 5 shows the wiper device 10 in radial section on plane V-V of FIG. 1, and FIG. 6 shows the wiper device 10 in radial section on plane VI-VI of FIG. 1. FIG. 7 is a superposition of the sections in FIGS. 5 and 6.

As shown in FIGS. 5 and 6, the radial sections of the blades 20 in their intermediate portions 24 are not circular.

Furthermore, the radially-inner faces 24*a* of at least some of the blades 20, and in this embodiment all of the blades 20, are curved.

As marked in FIG. 5, the smallest diametral dimension defined between the facing inner faces 24*a* of the blades 20 is written B2 (see also FIG. 8). In the embodiment described, the smallest diametral dimension is reached in the intermediate portions 24 of the blades 20.

As can be seen in FIG. 7, the distances to the axis X of the intermediate portions 24 are constant over the height of said intermediate portions 24.

The intermediate portions 24 are swirled and, independently, twisted. Specifically, they are swirled and twisted in such a manner that the radially-inner faces 24*a* form a continuous circle of diameter B2 in this embodiment. The continuous circle makes it possible, in particular, to wipe a stem of the fluid applicator completely. Thus, more generally, the projections of intermediate segments, comprising the intermediate portions 24, onto a plane that is orthogonal to the axis, cover a complete turn. Optionally, the projections of intermediate segments, comprising the intermediate portions 24, onto a plane that is orthogonal to the axis, may overlap.

FIG. 8 shows a liquid or paste applicator unit 100 comprising a container 40, an applicator 30, and the wiper device 10 described above. The wiper device 10 is mounted in the neck 42 of the container 40. The abutment 14 of the wiper device 10 co-operates with a shoulder 44 of the neck, so as to avoid driving the wiper device 10 too far into the neck 42. Furthermore, the beads 16 are compressed by the inner surface 46 of the neck so as to increase friction between the wiper device 10 and the neck 42, and so as to avoid the wiper device 10 coming out of the neck, in particular while wiping the applicator 30, when a force is applied on the wiper device 10 that is directed towards the outside of the container 40.

The applicator 30 includes a stem 32 and an applicator member 34. In this embodiment, the applicator member 34 is a brush, but any appropriate type of applicator member may be used. Likewise, any type of stem may be used, e.g. a stem in accordance with the unpublished French patent application No. 13 61488 in the name of the Applicant. In this embodiment, the applicator 30 is substantially a body of revolution.

The applicator member 34 extends axially beyond the stem 32. Specifically, the applicator member 34 includes a twisted wire. The twisted wire extends axially beyond the stem 32, in alignment with the stem 32 in this embodiment. The applicator member 34 also includes brush bristles that extend substantially radially from the twisted wire, i.e. along a direction that co-operates with a radial plane to form an angle lying in the range −45° to 45°. Furthermore, in a radial direction, the applicator member 34 extends beyond the stem 32. In this embodiment, the brush bristles extend radially beyond the stem 32.

In the present embodiment, the smallest diametral dimension B2 defined between the facing inner faces 24*a* of the blades 20 is less than a diameter A2 of a cross-section of the stem 32. Consequently, when the stem 32 passes between the intermediate portions 24 of the blades 20 that are flexible, the intermediate portions 24 move apart so as to adapt to the diameter A2 of the stem 32. The flexibility of the blades 20 results in a return force that presses the intermediate portions 24 against the stem 32. Thus, any fluid that might be on the stem 32 is particularly well scraped off by the intermediate portions 24.

In addition, the greatest diametral dimension A1 of the applicator member 34 is less than the greatest diametral dimension B1 defined between the facing inner faces 22*a* of the blades 20. Thus, the applicator member 34 is well wiped, including at its radially-outermost portion.

In addition, the greatest diametral dimension A1 of the applicator member 34 is naturally greater than the smallest diametral dimension B2 defined between the facing inner faces 24*a* of the blades 20. Specifically, this ensures that the applicator member 34 cannot pass through the wiper device 10 without being wiped. By means of this characteristic on its own, it could be possible to scrape off the fluid on the applicator member 34, without necessarily scraping off the fluid present on the stem 32.

Furthermore, the stem 32 of the applicator includes a constriction 36, i.e. a narrowing of the cross-section of the stem 32. Specifically, the constriction 36 has a diameter A3 that is less than the smallest diametral dimension B2 defined between the facing inner faces 24*a* of the blades 20. Furthermore, the constriction 36 is positioned axially on the stem 32 so that when the applicator 30 is stored, at rest, inside the container 40, the constriction 36 faces the facing inner faces 24*a* that present the smallest distance from the axis X. Thus, when the applicator 30 is stored in the container 40, the intermediate portions 24 do not bear against the stem 32 but face the constriction 36, thereby making it possible to hold the blades at rest, without stress. This makes it possible to increase the strength and the life span of the wiper device 10.

Although the present invention is described with reference to specific embodiments, modifications may be applied to them without going beyond the general ambit of the invention as defined by the claims. In particular, individual characteristics of the various embodiments shown and mentioned may be combined in additional embodiments. Consequently, the description and the drawings should be considered in a sense that is illustrative rather than restrictive.

The invention claimed is:

1. A wiper device for a liquid or paste applicator, the wiper device comprising a tubular body having an axis, and a plurality of blades that extend from the tubular body and that are arranged around the axis, each blade comprising a proximal end that is close to the tubular body, a distal end, and an intermediate portion, wherein the intermediate portion of each blade is closer to the axis of the tubular body than are the proximal and distal ends of said blade, and at least some of the blades are swirled, at least in part, having successive radial sections that are progressively offset relative to one another in a circumferential direction, and wherein at least some of the blades have radial sections that are not circular, and are blades that are twisted, at least in part.

2. A wiper device according to claim 1, wherein a proximal portion, situated between the intermediate portion and the proximal end, approaches the axis on going away from the body, while a distal portion, situated between the intermediate portion and the distal end, departs from the axis on going away from the body.

3. A wiper device according to claim 1, wherein the distal ends of the blades are free.

4. A wiper device according to claim 1, wherein end faces of some of the blades are not perpendicular to the axis.

5. A wiper device according to claim 1, wherein radially-inner faces of at least some of the blades are curved.

6. A wiper device according to claim 5, wherein, in projection onto a plane that is orthogonal to the axis of the tubular body, angular sectors occupied by distal portions and by proximal portions substantially cover a complete turn.

7. A wiper device according to claim 1, wherein projections of intermediate segments comprising the intermediate portions onto a plane that is orthogonal to the axis, cover a complete turn.

8. A liquid or paste applicator unit comprising a container having a neck, an applicator having a stem that is provided with an applicator member, and a wiper device according to claim 1 that is mounted in the neck of the container, wherein a smallest diametral dimension defined between facing inner faces of the blades is less than a diameter of a cross-section of the stem.

9. An applicator unit according to claim 8, wherein a greatest diametral dimension of the applicator member is less than a greatest diametral dimension defined between the facing inner faces of the blades.

10. An applicator unit according to claim 8, wherein the blades are more flexible than the stem of the applicator.

* * * * *